US009291412B1

(12) United States Patent
Montes

(10) Patent No.: US 9,291,412 B1
(45) Date of Patent: Mar. 22, 2016

(54) MONOLITHIC EXTENDED BOLT RELEASE (EBR) DEVICES AND METHODS

(75) Inventor: Kenneth Montes, Roseville, CA (US)

(73) Assignee: Phase 5 Weapon Systems Inc., Roseville, CA (US)

( * ) Notice: Subject to any disclaimer, the term of this patent is extended or adjusted under 35 U.S.C. 154(b) by 39 days.

(21) Appl. No.: 13/069,369

(22) Filed: Mar. 22, 2011

Related U.S. Application Data

(60) Provisional application No. 61/316,374, filed on Mar. 22, 2010.

(51) Int. Cl.
*F41A 3/72* (2006.01)

(52) U.S. Cl.
CPC ..... *F41A 3/72* (2013.01)

(58) Field of Classification Search
CPC ..... F41A 7/00; F41A 7/02; F41A 3/72; F41A 9/53
USPC ..... 89/1.4; 42/70.11, 1.05
See application file for complete search history.

(56) References Cited

U.S. PATENT DOCUMENTS

| | | | | |
|---|---|---|---|---|
| 4,588,043 | A * | 5/1986 | Finn | 89/14.4 |
| 4,827,652 | A * | 5/1989 | Martin | 42/142 |
| 6,722,253 | B2 * | 4/2004 | Johnson | F41A 3/12 42/90 |
| 7,219,462 | B2 * | 5/2007 | Finn | 42/49.01 |
| D621,467 | S | 8/2010 | Montes | |
| D652,468 | S * | 1/2012 | Burt et al. | D22/108 |
| 8,161,861 | B2 * | 4/2012 | Haley et al. | 89/1.4 |
| 8,695,477 | B2 * | 4/2014 | Esch | F41A 17/42 42/14 |
| 2003/0208940 | A1 * | 11/2003 | Johnson | F41A 3/12 42/18 |
| 2003/0230020 | A1 | 12/2003 | Christiansen | |
| 2005/0183310 | A1 * | 8/2005 | Finn | 42/49.01 |
| 2010/0251591 | A1 * | 10/2010 | Burt et al. | 42/70.01 |

FOREIGN PATENT DOCUMENTS

WO WO 2005/047804 A2 5/2005

OTHER PUBLICATIONS

Discussion thread downloaded on Jun. 25, 2009 from http://www.weaponevolution.com/forum/showthread.php?t=1159.
Discussion thread downloaded on Jun. 25, 2009 from http://www.snipercentral.com/forums/viewtopic.php?t=23631.
Ar15news.com, "Phase 5 Tactiacl EBRv2 (Extended Bolt Release) Counterfeits," http://www.ar15news.com/2013/08/16/phase-5-tactiacl-ebrv2-extended-bolt-release-counterfeits/, Aug. 16, 2013.
Montes, Kenneth; Declaration submitted under 37 CFR 1.132, 1.56, dated May 6, 2015.

* cited by examiner

*Primary Examiner* — Jonathan C Weber
(74) *Attorney, Agent, or Firm* — Law Office of Andrei D Popovici, PC

(57) ABSTRACT

In some embodiments, a monolithic extended bolt release (EBR) for a rifle includes a rifle mount including a pin aperture for securing the EBR to the rifle case/housing, a bolt stop plate integrally formed with the rifle mount for stopping the rifle bolt, and an extension arm integrally formed with the rifle mount and bolt stop plate. The extension arm includes a vertical straight arm extending from the rifle-mounting part to a trigger opening when the EBR is mounted on a rifle, and a horizontal straight arm connected to the vertical straight arm and passing through the trigger opening. A right-handed rifle user can release the bolt by pressing with finger(s) on the EBR on the right of the rifle, pivoting the EBR about the mounting pin, lowering a bolt stop plate of the EBR and allowing release of the bolt and reloading of the rifle. The EBR design displays superior reliability over extended periods of use in harsh conditions.

9 Claims, 5 Drawing Sheets

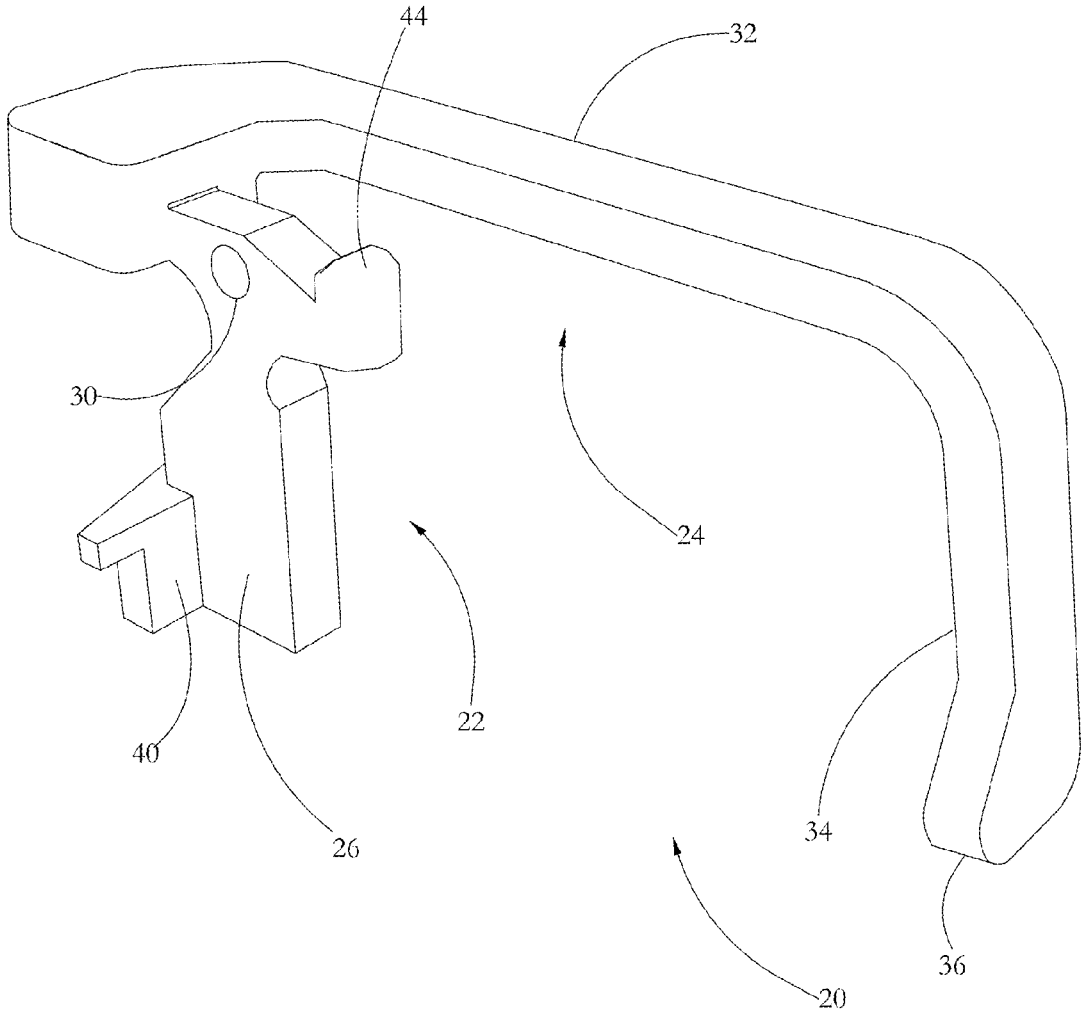
FIG. 1-A

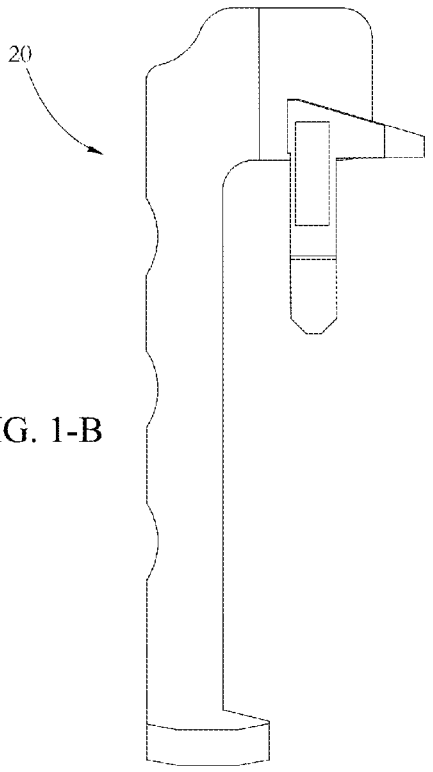
FIG. 1-B
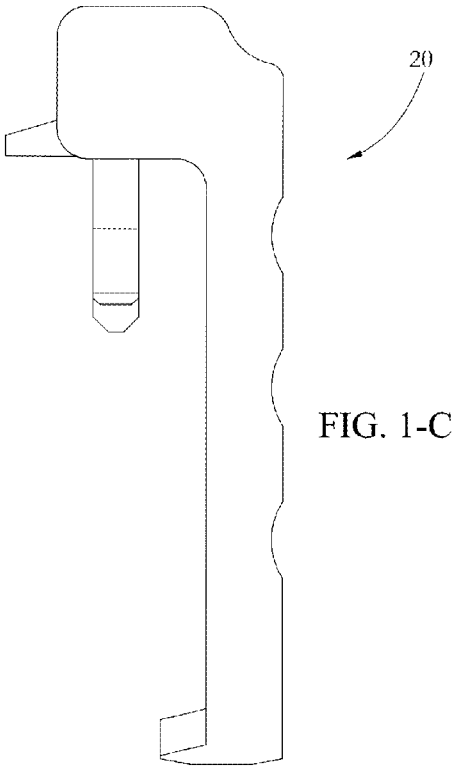
FIG. 1-C
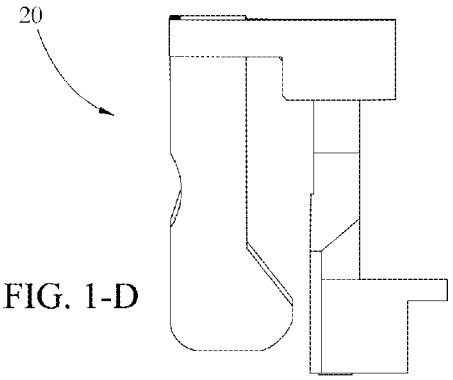
FIG. 1-D
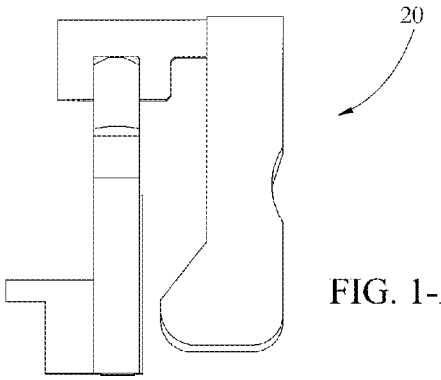
FIG. 1-E

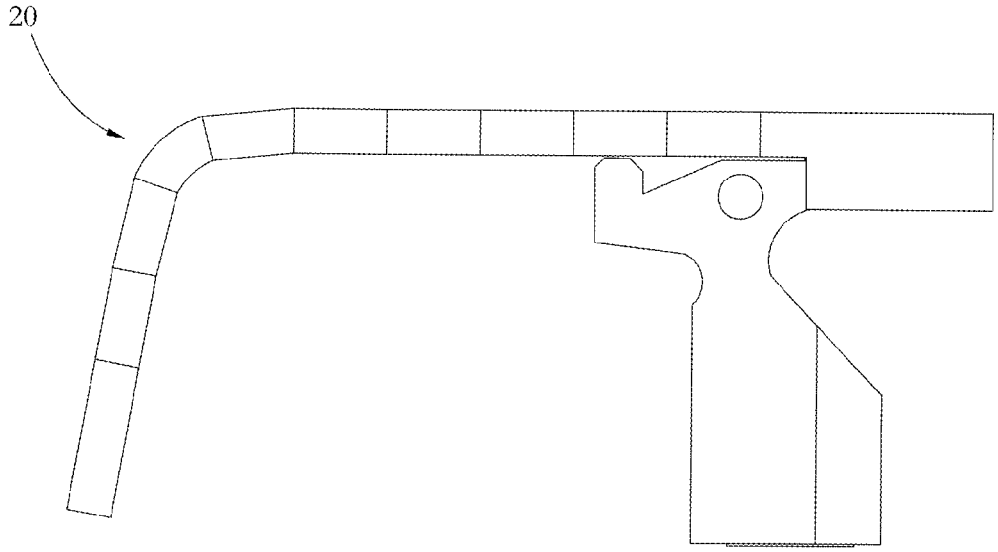
FIG. 1-F
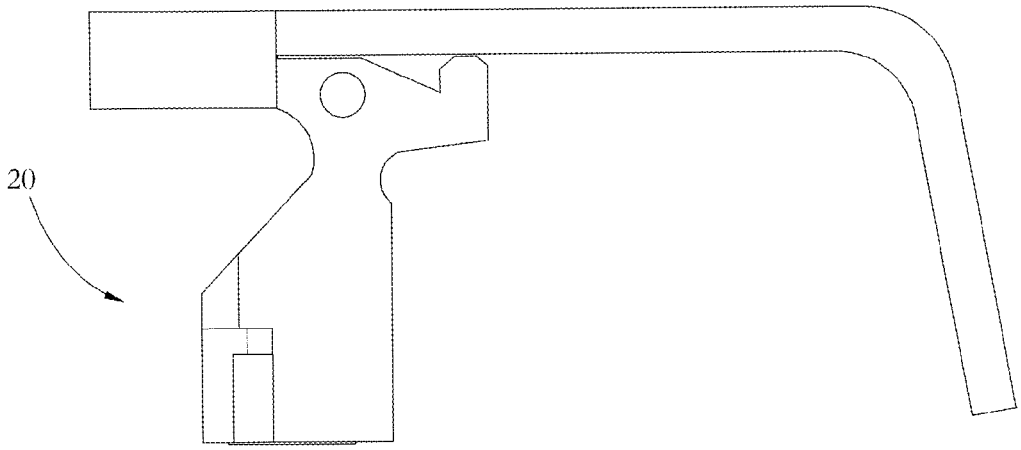
FIG. 1-G

MONOLITHIC EXTENDED BOLT RELEASE (EBR) DEVICES AND METHODS

RELATED APPLICATION DATA

This application claims the benefit of the filing date of U.S. Provisional Patent Application No. 61/316,374, filed on Mar. 22, 2010, entitled "Monolithic Extended Bolt Release (EBR) Devices and Methods," which is herein incorporated by reference.

BACKGROUND OF THE INVENTION

This invention relates to firearms, and in particular to extended bolt releases for rifles.

Some rifle designs, such as the AR-15/M4/M16, AR-10® and LR-308 designs, include a bolt release mechanism for stopping and releasing the rifle bolt to allow chambering the first round in a newly replaced magazine. In the AR-15 design, the bolt is released by pressing a bolt stop paddle (tab) situated above the trigger area on the left side of the rifle, as viewed from the standpoint of a person holding the rifle in a firing position, pointing forward.

SUMMARY OF THE INVENTION

According to one aspect, a monolithic extended bolt release (EBR) for a rifle includes a bolt stop and an extension arm integrally formed with the bolt stop. The bolt stop has a bolt stop face for stopping a bolt of the firearm, and a pin aperture for pivotably securing the EBR directly to an outside surface of a body of the firearm. The extension arm includes a vertical straight arm extending from the bolt stop to a trigger opening of the firearm when the EBR is mounted on the firearm body, and a horizontal straight arm connected to the vertical straight arm and passing through the trigger opening.

BRIEF DESCRIPTION OF THE DRAWINGS

The foregoing aspects and advantages of the present invention will become better understood upon reading the following detailed description and upon reference to the drawings where:

FIGS. 1-A-G show isometric and plan views of a ridged-lateral-surface monolithic extended bolt release (EBR) for a firearm according to some embodiments of the present invention.

DETAILED DESCRIPTION OF THE INVENTION

Figure 2:
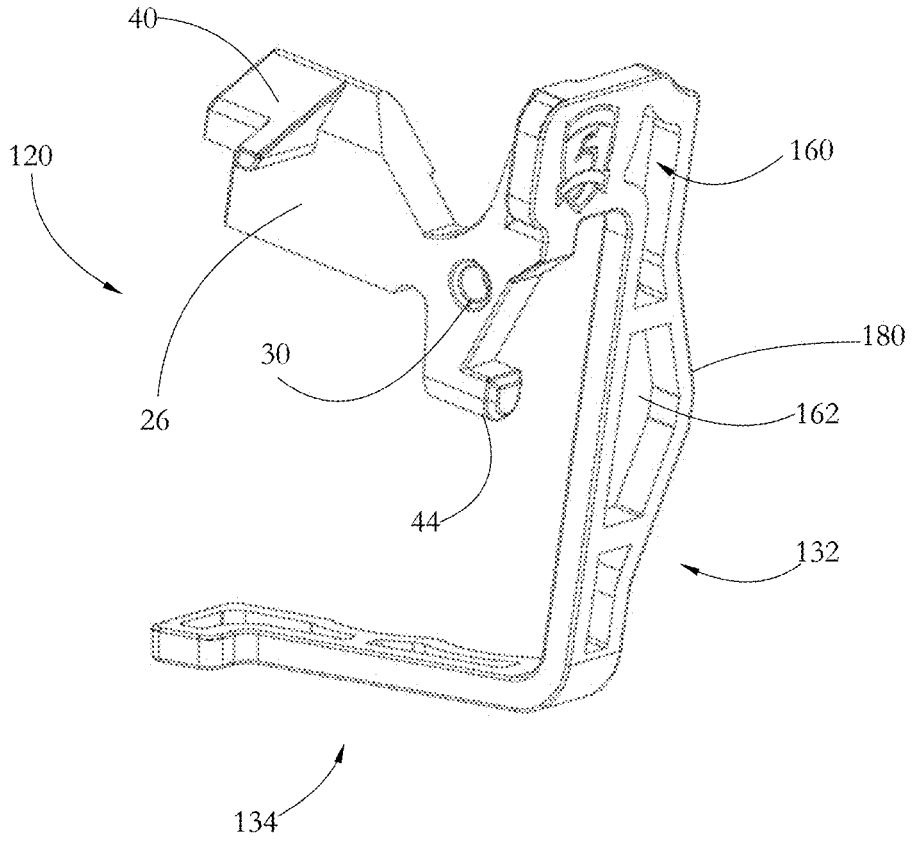
FIG. 2 shows an isometric view of a monolithic EBR having weight-reduction apertures defined therein, according to some embodiments of the present invention.

The following description illustrates the present invention by way of example and not necessarily by way of limitation. A set of elements includes one or more elements. A plurality of elements includes two or more elements. Any recitation of an element is understood to refer to at least one element. Unless otherwise required, any described method steps need not be necessarily performed in a particular illustrated order. A monolithic EBR may be an EBR formed from a single piece of material (e.g. metal) by a process such as forging/molding or machining, or a single-piece EBR formed from two or more pieces of material by an irreversible process, such as welding or irreversible dovetail press-fitting, which does not lead to loosening of the connection as a result of repeated firearm use. A monolithic EBR does not encompass EBRs formed by connecting multiple parts by reversible processes such as screwing or bolting.

FIGS. 1-A-G show isometric and plan views of a monolithic extended bolt release (EBR) 20 according to some embodiments of the present invention. EBR 20 includes a bolt stop 22 for mounting EBR 20 onto a rifle and for stopping a motion of the rifle bolt (see FIG. 3), and an extended release member 24 connected to and integrally formed with bolt stop 22, for allowing a rifle user to press release member 24 from the rifle side opposite that of the connection of bolt stop 22, to release the rifle bolt. Bolt stop 22 includes a bolt stop plate 26 having a face which contacts the rifle bolt to stop the bolt motion when the rifle magazine is empty, and an EBR mounting pin hole 30 for mounting EBR 20 to the rifle. Member 24 includes a vertical straight arm 32 extending between the location of mounting hole 30 and the trigger area of the rifle, and a horizontal (transverse) straight arm 34 extending across the trigger area of the rifle. To release the rifle bolt, the rifle user presses downward on an end 36 of arm 34. To lock the rifle bolt, the rifle user presses upward on end 36. In some embodiments, end 36 is situated on the right side of the rifle, and thus can be pressed using a right-handed user's finger(s), while mounting pin hole 30 is situated on the left side of the rifle, as in a conventional AR-15 design. Bolt stop 22 also includes a magazine follower contact 40 for contacting the magazine follower when the rifle magazine has become empty, as well as an engagement button 44 for allowing a user, by pressing on engagement button 44, to pivot bolt stop 22 upward to stop the rifle bolt.

The exemplary EBR 20 illustrated in FIGS. 1-A-G includes lateral ridges along vertical straight arm 32, as can be seen in the top views of FIGS. 1-B-C. In some embodiments, a monolithic EBR may have a flat rather than ridged surface, and/or may include weight reduction apertures (cuts).

FIG. 2 shows an isometric view of a monolithic EBR 120 having weight-reduction apertures 160 defined along a vertical straight arm 132 and a horizontal (transverse) straight arm 134. In particular, a central aperture 162 is large enough to allow removing a trigger pin through the aperture 162. In some rifle designs, one of two rifle trigger pins is positioned immediately behind vertical straight arm 132. In some embodiments, central aperture 162 may be replaced by a lateral notch defined in vertical straight arm 132 to allow access to the trigger pin. Vertical arm 132 also includes a lateral extension/protrusion 180 extending laterally toward the body of the user (i.e. toward rear of the rifle), which brings the surface of vertical arm 132 slightly closer to a user's left-hand index finger when a user holds the rifle grip in his left hand. Lateral protrusion 180 makes it easier for a user to press on vertical straight arm 132 from the left to lock the bolt. The structure and operation of EBR 120 may be otherwise similar to those of EBR 20.

Figure 3:
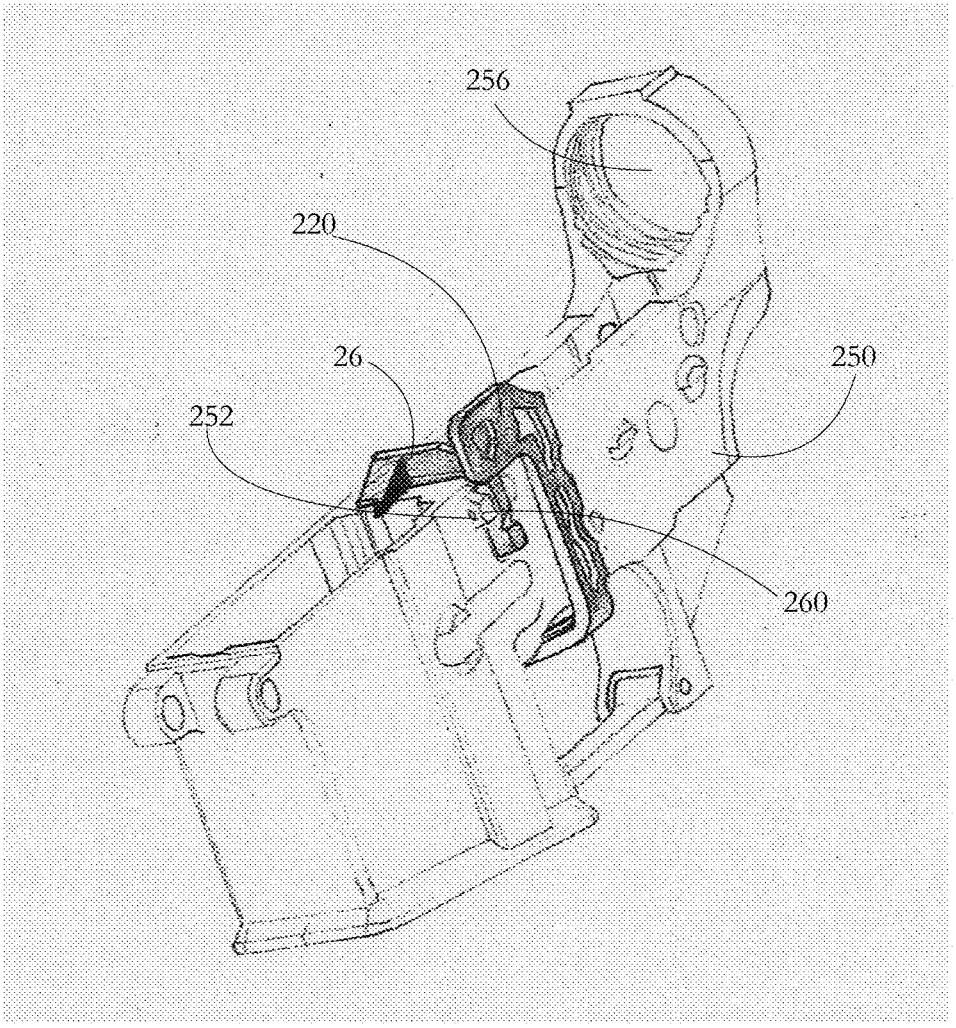
FIG. 3 shows an isometric view of a rifle assembly including a monolithic EBR, according to some embodiments of the present invention.

FIG. 3 shows a monolithic EBR 220 mounted on a rifle 250. Only the lower receiver of rifle 250 is shown. The upper receiver is not attached, which allows showing a rifle bolt aperture 256, which accommodates the rifle bolt. A longitudinal (parallel to the barrel) roll pin 252 passes through a corresponding mounting hole 30 formed in EBR 220 and two corresponding mounting holes formed in a protrusion 260 of the lower receiver metal housing. The rifle housing holes are on opposite sides of mounting hole 30. When a user presses on the EBR end protruding on the right-side of the rifle (not visible in FIG. 3), EBR 220 pivots about the longitudinal axis defined by the roll pin 152, lowering bolt stop plate 26 out of the path of bolt 254 and allowing the user to replace the rifle magazine.

A non-monolithic EBR may be constructed by attaching an arm to a stock bolt stop paddle using a removable attachment such as bolts or screws. For example, a stock bolt stop paddle may be sandwiched between an EBR arm and mounting plate, and a set of mounting screws may be tightened to hold the EBR in place. Such a removable attachment design can lead to loosening of the bolts/screws and attachment over time, as the rifle and EBR are subject to shocks due to firing, bolt stop contacts, and bumps/shocks applied to the EBR from dropping the rifle or other contact between the rifle and hard surfaces/objects. Such a sandwich attachment may also require additional space between the EBR and the outer surface of the upper receiver of the rifle; some rifle designs include a relatively-thick and strong upper receiver, which may not allow sufficient spacing for the back plate. By contrast, exemplary monolithic EBR designs as described above allow achieving superior reliability over extended periods of use in harsh conditions, and allow the use of the EBR with thick upper rifle receivers.

A monolithic EBR as described above may be made by forging, machining, or welding. Welding can be used to permanently and integrally connect a stock bolt stop paddle to an extension arm to form an EBR as shown in FIGS. 1-3. While casting could be used to yield a monolithic structure, casting may yield a relatively brittle material not suited for reliable use in military applications. In some embodiments, a secure irreversible connection may be established by dovetail press-fitting rather than welding to yield a monolithic part that would not become loose over repeated shocks.

The material used for the EBR may be chosen so as to allow repeated, reliable use of the EBR in the presence of repeated shocks due to rifle firing, bolt stop contacts with the EBR stop plate when the magazine has been emptied, and external shocks applied to the EBR/rifle. In some embodiments, the EBR may be made from a hard, machinable material such as 41xx steel (chromoly alloy), e.g. 4140 steel. The EBR material may be chosen to be similar in hardness to the rifle bolt, so that repeated hits by the bolt do not weaken or change the shape of the EBR bolt stop plate.

In some embodiments, vertical arm 32 has a length of about 4-6 cm, for example about 5 cm, horizontal arm 34 has a length of about 3 to 5 cm, for example about 3.5 cm, bolt stop plate 26 horizontal/vertical dimensions of about 1-2×1-2 cm, for example about 2×1 cm, while mounting hole 30 has a circular shape and a diameter of about 2-4 mm (e.g. about 3/32"). The thickness of the EBR structure may be about 2-4 mm, for example about 3 mm.

The above embodiments may be altered in many ways without departing from the scope of the invention. Accordingly, the scope of the invention should be determined by the following claims and their legal equivalents.

What is claimed is:

1. An extended bolt release (EBR) for a firearm including:
a bolt stop having
a bolt stop face for stopping a bolt of the firearm, and
a pin aperture for pivotably securing the EBR directly to an outside surface of a body of the firearm, and
an extension arm connected to the bolt stop, wherein the extension arm includes a vertical straight arm extending from the bolt stop to a trigger opening of the firearm when the EBR is mounted on the firearm body, and a horizontal straight arm connected to the vertical straight arm and passing through the trigger opening, wherein the vertical straight arm includes a central aperture sized to allow passage of a firearm trigger pin through the central aperture, for allowing removal of the firearm trigger pin through the central aperture.

2. The EBR of claim 1, wherein the EBR is made of steel.

3. The EBR of claim 1, wherein the EBR is monolithic, whereby the extension arm is integrally formed with the bolt stop.

4. A firearm assembly including:
a firearm body; and
an extended bolt release for the firearm, including
a bolt stop having
a bolt stop face for stopping a bolt of the firearm, and
a pin aperture for pivotably securing the EBR directly to an outside surface of a body of the firearm, and
an extension arm connected to the bolt stop, wherein the extension arm includes a vertical straight arm extending from the bolt stop to a trigger opening of the firearm when the EBR is mounted on the firearm body, and a horizontal straight arm connected to the vertical straight arm and passing through the trigger opening, wherein the vertical straight arm includes a central aperture sized to allow passage of a firearm trigger pin through the central aperture, for allowing removal of the firearm trigger pin through the central aperture.

5. The firearm assembly of claim 4, wherein the EBR is made of steel.

6. The firearm assembly of claim 4, wherein the EBR is monolithic, whereby the extension arm is integrally formed with the bolt stop.

7. A method comprising forming an extended bolt release (EBR) for a firearm, wherein the EBR includes:
a bolt stop having
a bolt stop face for stopping a bolt of the firearm, and
a pin aperture for pivotably securing the EBR directly to an outside surface of a body of the firearm, and
an extension arm connected to the bolt stop, wherein the extension arm includes a vertical straight arm extending from the bolt stop to a trigger opening of the firearm when the EBR is mounted on the firearm body, and a horizontal straight arm connected to the vertical straight arm and passing through the trigger opening, wherein the vertical straight arm includes a central aperture sized and positioned to allow passage of a firearm trigger pin through the central aperture, for allowing removal of the firearm trigger pin through the central aperture.

8. The method of claim 7, wherein the EBR is made of steel.

9. The method of claim 7, wherein the EBR is monolithic, whereby the extension arm is integrally formed with the bolt stop, and wherein the method comprises forming the EBR by forging, machining, or welding.

* * * * *